US008628315B2

(12) United States Patent
Sato et al.

(10) Patent No.: US 8,628,315 B2
(45) Date of Patent: Jan. 14, 2014

(54) FLUID MACHINE

(75) Inventors: Hajime Sato, Aichi (JP); Makoto Takeuchi, Aichi (JP); Hiroshi Yamazaki, Aichi (JP); Shinta Mishima, Aichi (JP); Kazuhide Watanabe, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 778 days.

(21) Appl. No.: 12/442,810

(22) PCT Filed: Sep. 25, 2007

(86) PCT No.: PCT/JP2007/068531

§ 371 (c)(1),
(2), (4) Date: Jan. 5, 2010

(87) PCT Pub. No.: WO2008/038622

PCT Pub. Date: Apr. 3, 2008

(65) Prior Publication Data

US 2010/0119397 A1 May 13, 2010

(30) Foreign Application Priority Data

Sep. 26, 2006 (JP) ..... 2006-260588

(51) Int. Cl.
*F01C 1/02* (2006.01)

(52) U.S. Cl.
USPC ..... 418/55.3

(58) Field of Classification Search
USPC ..... 418/55.1–55.6
See application file for complete search history.

(56) References Cited

U.S. PATENT DOCUMENTS

| | | | | |
|---|---|---|---|---|
| 4,344,717 | A * | 8/1982 | Merz | 403/14 |
| 5,542,829 | A * | 8/1996 | Inagaki et al. | 418/55.3 |
| 5,791,885 | A * | 8/1998 | Fukuhara et al. | 418/55.2 |
| 5,807,089 | A * | 9/1998 | Tsumagari et al. | 418/55.3 |

(Continued)

FOREIGN PATENT DOCUMENTS

| | | | |
|---|---|---|---|
| JP | 8-338376 | A | 12/1996 |
| JP | 2001-73966 | A | 3/2001 |
| JP | 2001-90679 | A | 4/2001 |
| JP | 2003-239874 | A | 8/2003 |
| JP | 2004-19488 | A | 1/2004 |

(Continued)

OTHER PUBLICATIONS

International Search Report of PCT/JP2007/068531, date of mailing Oct. 23, 2007.

(Continued)

*Primary Examiner* — Thomas Denion
*Assistant Examiner* — Steven D Shipe
(74) *Attorney, Agent, or Firm* — Westerman, Hattori, Daniels & Adrian, LLP

(57) ABSTRACT

Intended is to provide a fluid machine that can prevent wear of a rotation preventing pin. The fluid machine includes a housing, a fixed scroll fixed with respect to the housing, a turning scroll that revolves around the fixed scroll, and a rotation preventing mechanism that prevents the rotation of the turning scroll. The rotation preventing mechanism includes a rotation preventing pin projected from a wall surface at the housing side or the turning scroll side, and a restraining member that restricts the position of the rotation preventing pin by engaging with the rotation preventing pin. A projecting side end of the rotation preventing pin has a taper shape, and the end of the taper shape has an R-shape.

6 Claims, 3 Drawing Sheets

(56) References Cited

U.S. PATENT DOCUMENTS

| | | | | |
|---|---|---|---|---|
| 5,842,844 | A * | 12/1998 | Oki et al. | 418/55.3 |
| 5,911,566 | A * | 6/1999 | Terauchi et al. | 418/55.3 |
| 6,095,779 | A * | 8/2000 | Nieman et al. | 418/55.3 |
| 6,109,898 | A * | 8/2000 | Scarlett | 418/55.3 |
| 6,264,444 | B1 * | 7/2001 | Nakane et al. | 418/55.3 |
| 2006/0171830 | A1 * | 8/2006 | Takei | 418/55.3 |
| 2008/0145253 | A1 * | 6/2008 | Uekawa | 418/55.3 |
| 2009/0028736 | A1 * | 1/2009 | Theodore, Jr. | 418/55.2 |

FOREIGN PATENT DOCUMENTS

| | | | |
|---|---|---|---|
| JP | 2005-155577 | A | 6/2005 |

OTHER PUBLICATIONS

International Search Report of PCT/JP2007/068531, date of mailing date Oct. 23, 2007.

Japanese Office Action dated Sep. 6, 2011, issued in corresponding Japanese Patent Application No. 2006-260588.

* cited by examiner

FLUID MACHINE

TECHNICAL FIELD

The present invention relates to a fluid machine. More specifically, the present invention relates to a fluid machine that can prevent wear of a rotation preventing pin.

BACKGROUND ART

In recent years, fluid machines represented by a scroll compressor and the like, include a rotation preventing pin projected from a wall surface at the side of a housing or at the side of a turning scroll, and a restraining member that restricts the position of the rotation preventing pin by engaging with the rotation preventing pin, as a rotation preventing mechanism of the turning scroll with respect to the housing.

As conventional fluid machines employing such a structure, a technology disclosed in Patent Document 1 is known. In the conventional fluid machine (scroll compressor), a fixed scroll that has a substrate and a scroll portion, and a movable scroll that has a substrate and a scroll portion, are arranged in a housing in a state that the scrolls are meshed with each other in the scroll portions. Accordingly, a compression chamber is formed between both scroll members, and gas is compressed by moving the compression chamber towards the center of the scroll portions from the outer peripheral side thereof, by revolving the movable scroll around the shaft center of the fixed scroll. As a mechanism that prevents the movable scroll from rotating and allows its revolution, a plurality of pairs of fitting holes is formed in the substrate of the movable scroll and in the inner wall of the housing facing thereto, the rotation preventing pin is pressed into each of the fitting holes, and a rotation preventing ring (restraining member) is inserted and fitted between projecting ends of each of the pair of the rotation preventing pins. In such a scroll compressor, a chamfered portion smoothly connected with the outer periphery of the pin is formed at the outer peripheral rim of the end at the side of the fitting hole of each of the rotation preventing pins.

[Patent document 1] Japanese Patent Application Laid-open No. H8-338376

DISCLOSURE OF INVENTION

Problem to be solved by the Invention

However, in the conventional fluid machine, there is a problem that the rotation preventing pin gets worn, because surface contact between the rotation preventing pin and the restraining member is increased, while the turning scroll is being revolved.

The present invention has been made in view of the above circumstances, and has an object to provide a fluid machine that can prevent wear of the rotation preventing pin.

Means for Solving Problem

According to an aspect of the present invention, a fluid machine includes: a housing; a fixed scroll fixed with respect to the housing; a turning scroll that revolves around the fixed scroll; and a rotation preventing mechanism that prevents a rotation of the turning scroll. The rotation preventing mechanism includes a rotation preventing pin projected from a wall surface at a side of the housing or a side of the turning scroll and a restraining member that restricts a position of the rotation preventing pin by engaging with the rotation preventing pin, and a projecting side end of the rotation preventing pin has a taper shape and an end of the taper shape has an R-shape.

In a fluid machine, a projecting side end of a rotation preventing pin has a shape (substantially crowned shape) smoothly tapered to a taper shape and an R-shape. Accordingly, even if a positional relationship between the rotation preventing pin and the restraining member is changed, surface contact between the rotation preventing pin and the restraining member is properly maintained. This provides an advantage that the wear of the rotation preventing pin can be reduced, because a contact surface pressure between the rotation preventing pin and the restraining member is decreased.

In the fluid machine according to the present invention, advantageously, a taper angle $\alpha$ of the rotation preventing pin and an inclination angle p at a side of the restraining member has a relationship of $\alpha \geq \beta$.

In the fluid machine, the relationship between the taper angle $\alpha$ and the inclination angle $\beta$ is optimized. Accordingly, the tapered surface (taper shape) of the rotation preventing pin and the inner peripheral surface of the restraining member are preferably in contact with each other while the turning scroll is being revolved. This provides an advantage that the wear of the rotation preventing pin can be reduced, because the contact surface pressure between the rotation preventing pin and the restraining member is decreased.

In the fluid machine according to the present invention, advantageously, the rotation preventing pin has a symmetrical shape in a longitudinal direction.

In the fluid machine, when the rotation preventing pin is pressed into the insertion hole of the housing, either tip of the rotation preventing pin may be the projecting side. This provides an advantage that the installation process of the rotation preventing pin can be simplified (improve assemblability).

In the fluid machine according to the present invention, advantageously, the taper shape of the rotation preventing pin changes in stages.

In the fluid machine, there is an advantage that the versatile taper shape can be formed.

Effect of the Invention

In a fluid machine according to the present invention, a projecting side end of a rotation preventing pin has a shape (substantially crowned shape) smoothly tapered to a taper shape and an R-shape. Accordingly, even if a positional relationship between the rotation preventing pin and the restraining member is changed, surface contact between the rotation preventing pin and the restraining member is properly maintained. This provides an advantage that the wear of the rotation preventing pin can be reduced, because a contact surface pressure between the rotation preventing pin and the restraining member is decreased.

EXPLANATIONS OF LETTERS OR NUMERALS

Figure 1:
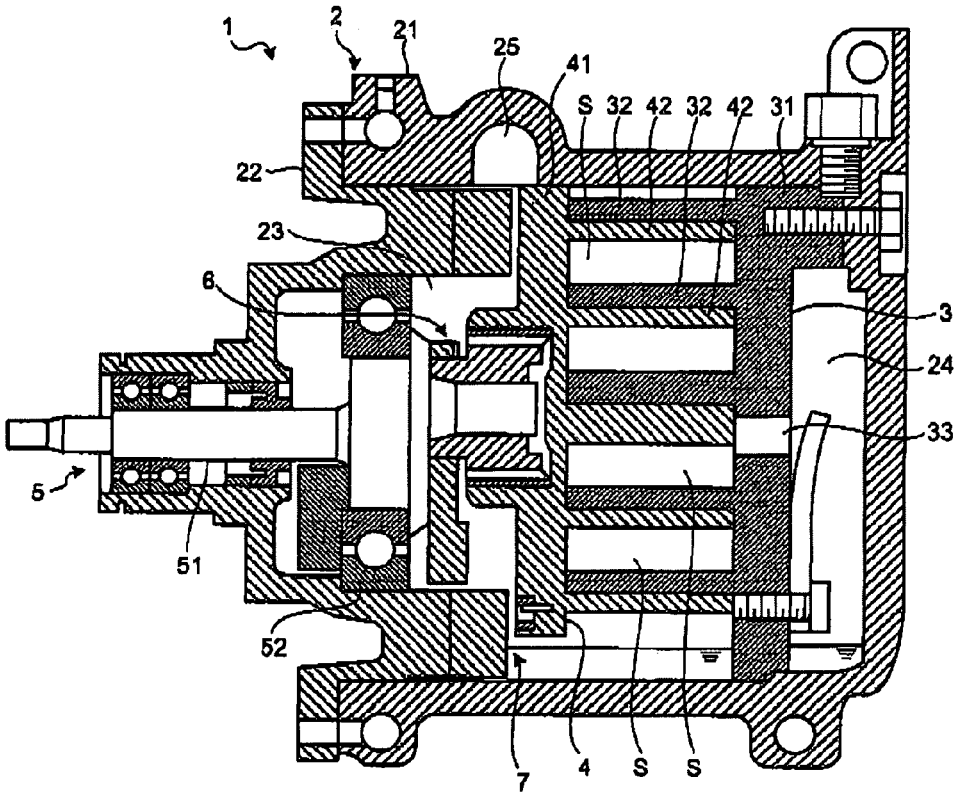
FIG. 1 is a view of a fluid machine according to an embodiment of the present invention.

1 fluid machine
2 housing
21 housing main body
22 front case
23 inlet chamber
24 outlet chamber
25 inlet port
3 fixed scroll
31 end plate
32 lap
33 hole
4 turning scroll
41 end plate
42 lap
5 drive mechanism
51 rotating shaft
52 main bearing
6 intermediate mechanism
7 rotation preventing mechanism
71 rotation preventing pin
72 restraining member
711 side surface
712 top surface
713 taper shape

BEST MODE(S) FOR CARRYING OUT THE INVENTION

Exemplary embodiments of the present invention are described in greater detail with reference to the accompanying drawings. The present invention is not limited to the embodiments. Components of the embodiments include those that can be easily replaced by persons skilled in the art, or those substantially the same. A plurality of modifications disclosed in the embodiments can be arbitrarily combined within a scope obvious to persons skilled in the art.

Embodiment

Figure 2:
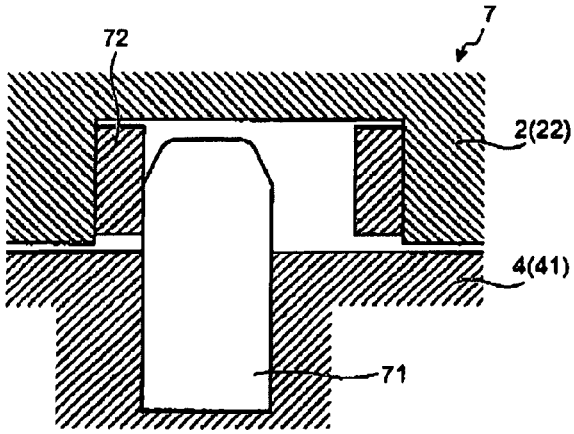
FIG. 2 is a sectional view of a rotation preventing mechanism of the fluid machine disclosed in FIG. 1.
Figure 3:
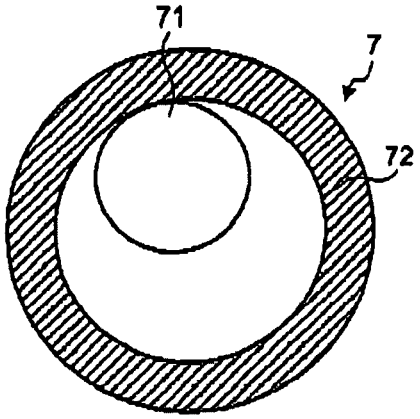
FIG. 3 is a sectional view of the rotation preventing mechanism of the fluid machine disclosed in FIG. 1.
Figure 4:
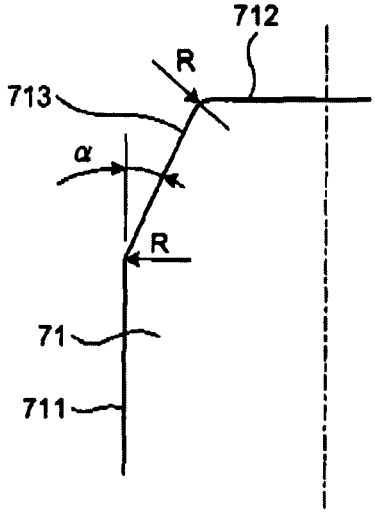
FIG. 4 is a schematic for explaining a rotation preventing pin of the rotation preventing mechanism disclosed in FIG. 2.
Figure 5:
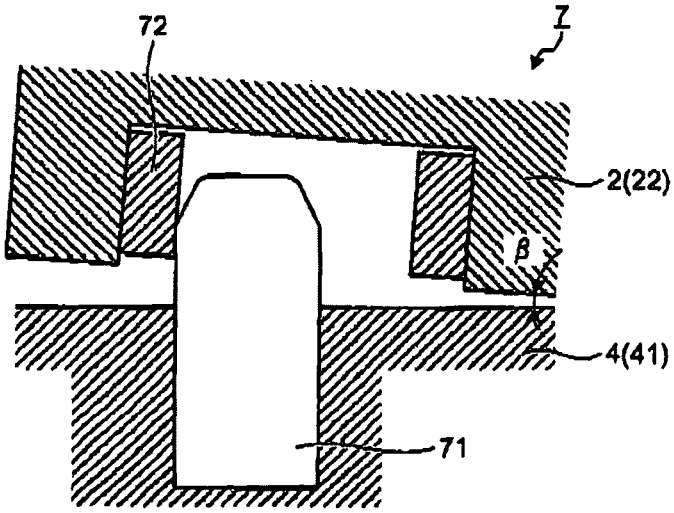
FIG. 5 is a schematic for explaining an operation of the rotation preventing mechanism disclosed in FIG. 2.
Figure 6:
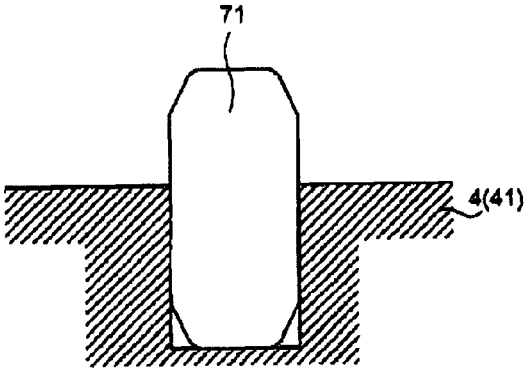
FIG. 6 is a schematic for explaining a modification of the rotation preventing mechanism disclosed in FIG. 2.
Figure 7:
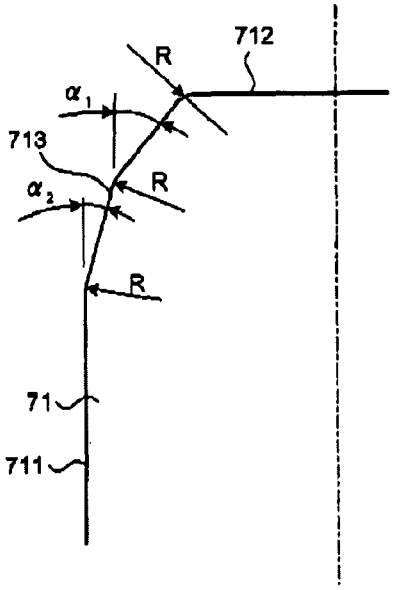
FIG. 7 is a schematic for explaining a modification of the rotation preventing mechanism disclosed in FIG. 2.
Figure 8:
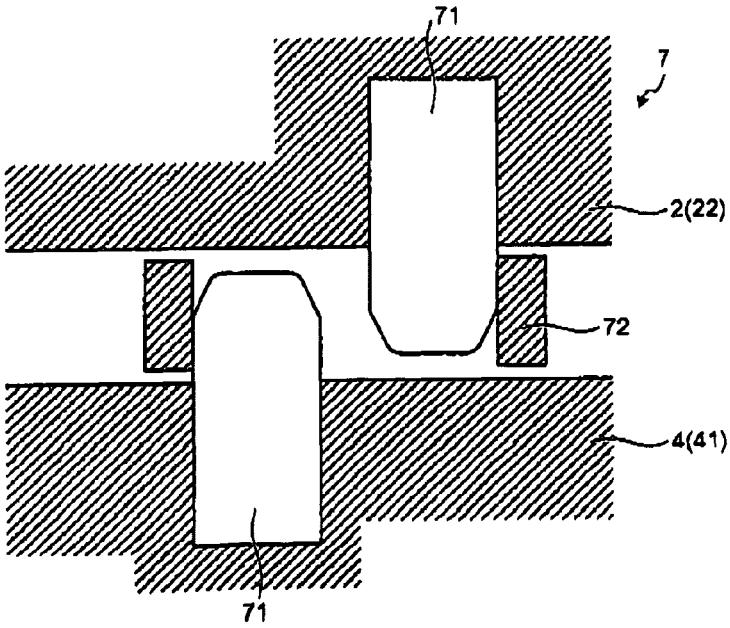
FIG. 8 is a schematic for explaining a modification of the rotation preventing mechanism disclosed in FIG. 2.

FIG. 1 is a schematic of a fluid machine according to an embodiment of the present invention. FIGS. 2 and 3 are sectional views of a rotation preventing mechanism of the fluid machine disclosed in FIG. 1. FIG. 4 is a schematic for explaining a rotation preventing pin of the rotation preventing mechanism disclosed in FIG. 2. FIG. 5 is a schematic for explaining an operation of the rotation preventing mechanism disclosed in FIG. 2. FIGS. 6 to 8 are schematics for explaining modifications of the rotation preventing mechanism disclosed in FIG. 2.

[Fluid Machine]

A fluid machine 1, for example, is a scroll compressor of an air conditioner, and has a function of compressing gas (refrigerant) to supply compressed gas to a refrigerant circuit of the air conditioner. In FIG. 1, the fluid machine 1 includes a housing 2, a fixed scroll 3, a turning scroll 4, a drive mechanism 5, and an intermediate mechanism 6.

The housing 2 includes a housing main body 21 and a front case 22. The housing main body 21 is formed of a container-shaped member, and includes an inlet chamber 23 and an outlet chamber 24 therein. The housing main body 21 also includes an inlet port 25 and an outlet port, which is not shown, at the side thereof. The front case 22 is a case to accommodate the drive mechanism 5 therein, and seals the inside of the housing main body 21 by being attached to an opening of the housing main body 21. The front case 22 is bolt-connected (not shown) with respect to the housing main body 21. In the fluid machine 1, outside gas is supplied into the inlet chamber 23 in the housing 2 from the inlet port 25, and the gas within the outlet chamber 24 is ejected to the outside from the outlet port, which is not shown.

The fixed scroll 3 includes an end plate 31, and a lap 32 in a spiral shape formed at the end plate 31. The fixed scroll is accommodated in the housing 2 with the lap 32 facing the side of the inlet chamber 23, and fixedly installed at an inner wall surface of the housing 2 by the end plate 31. The fixed scroll 3 (end plate 31) is also used as a partition member that partitions between the inlet chamber 23 and the outlet chamber 24 in the housing 2.

The turning scroll 4 includes an end plate 41 and a lap 42 in a spiral shape formed at the end plate 41. The turning scroll 4 is installed in the housing 2, so that the lap 42 is meshed with the lap 32 of the fixed scroll 3 while being eccentric. With such an arrangement structure, a plurality of enclosed spaces S is formed between the laps 32 and 42 of the fixed scroll 3 and the turning scroll 4. The turning scroll 4 is disposed so as to revolve around the fixed scroll 3 while preventing the rotation thereof. The turning scroll 4 and the fixed scroll 3 are arranged, so that the volume of the enclosed spaces S gradually decreases by the revolving motion of the turning scroll 4.

The drive mechanism 5 includes a rotating shaft 51 and a main bearing 52. The rotating shaft 51 is a drive shaft to drive the turning scroll 4. The rotating shaft 51 is connected to an outside power source at one of the ends, and connected to the intermediate mechanism 6 at the other end. The main bearing 52 is a bearing for supporting the rotating shaft 51, and disposed in the front case 22.

The intermediate mechanism 6 is a mechanism to connect the rotating shaft 51 of the drive mechanism 5 and the turning scroll 4, and for example, formed by an Oldham mechanism. The intermediate mechanism 6 has a function of converting the rotating motion of the rotating shaft 51 to the revolving motion, and transmitting thereof to the turning scroll 4.

In the fluid machine 1, when the rotating shaft 51 rotates, the power is transmitted to the turning scroll 4 via the intermediate mechanism 6. The turning scroll 4 then revolves around the fixed scroll 3 while being eccentric. Accordingly, gas in the inlet chamber 23 is taken into the enclosed spaces S between the turning scroll 4 and the fixed scroll 3 from the surroundings, and the gas inside the enclosed spaces S is compressed, because the enclosed spaces S are narrowed. The compressed gas is discharged from a hole 33 formed substantially at the center of the fixed scroll 3, flowed into the outlet chamber 24, and supplied to outside by being ejected from the cutlet port, which is not shown.

[Rotation Preventing Mechanism]

In FIG. 1, the fluid machine 1 also includes a rotation preventing mechanism 7. The rotation preventing mechanism 7 has a function of preventing the rotation of the turning scroll 4, and is arranged so as to be interposed between the housing 2 (front case 22) and the turning scroll 4. A plurality of rotation preventing mechanisms 7 is aligned along the periphery of the turning scroll 4 in a ring-shape. In FIGS. 2 and 3, the rotating preventing mechanism 7 includes a rotation preventing pin 71 and a restraining member (rotation preventing ring) 72. The rotation preventing pin 71 has a substantially columnar pin shape and is installed so as to project towards the side of the front case 22 from the plane of the end plate 41 of the turning scroll 4. The restraining member 72 has a cylinder shape (ring shape), and is installed by being pressed into an insertion hole formed in the wall surface at the side of the front case 22. The turning scroll 4 is assembled to the housing 2, so that the tip of the rotation preventing pin 71 is positioned inside the restraining member 72.

In the rotation preventing mechanism 7, when the turning scroll 4 revolves while the fluid machine 1 is being operated, the rotation preventing pin 71 is displaced with (the end plate 41 of) the turning scroll 4. At this time, the position of the rotation preventing pin 71 is restricted, because the side surface (sliding surface) of the rotation preventing pin 71 engages (slides) with the inner peripheral surface of the restraining member 72. Accordingly, the turning scroll 4 is restrained, thereby preventing the rotation of the turning scroll 4.

In FIG. 4, the projecting side end of the rotation preventing pin 71 is crowned. In other words, the projecting side end of the rotation preventing pin 71 includes a taper shape (taper unit) 713 formed from at least a part (or all) of a side surface (sliding surface with respect to the restraining member 72) 711 to the top surface 712. Accordingly, the rotation preventing pin 71 has a shape whose diameter is gradually tapered towards the projecting side end from the side surface 711. Both ends of the taper shape 713 have an R'shape. More specifically, R-chamfering is performed at a boundary portion between the side surface 711 and the taper shape 713, and the R-chamfering is also performed at a boundary portion between the taper shape 713 and the top surface 712. Therefore, the rotation preventing pin 71 has a shape smoothly tapered to the top surface 712 from the side surface 711.

In FIG. 5, in such a structure, when an inclination angle β of (the end plate 41 of) the turning scroll 4 with respect to (the front case 22 of) the housing 2 changes while the turning scroll 4 is being revolved, the positional relationship between the rotation preventing pin 71 and the restraining member 72 is changed accordingly. For example, in the structure that the restraining member 72 is buried at the side of the housing 2 as the above, the inner peripheral surface of the restraining member 72 is abutted to the projecting side end of the rotation preventing pin 71 from an oblique direction.

At this time, in the above structure, the projecting side end of the rotation preventing pin 71 has a shape (substantially crowned shape) smoothly tapered to the taper shape 713 and the R-shape. Accordingly, even if the positional relationship between the rotation preventing pin 71 and the restraining member changes, the surface contact between the rotation preventing pin 71 and the restraining member 72 is properly maintained. This provides an advantage that the wear of the rotation preventing pin can be reduced, because the contact surface pressure between the rotation preventing pin 71 and the restraining member 72 is decreased.

For example, in a structure (not shown) that the rotation preventing pin has a substantially columnar shape and C-chamfering is performed to the tip thereof, when the restraining member abuts the projecting side end of the rotation preventing pin from the oblique direction, the restraining member and the C-chamfered portion of the rotation preventing pin are in partial contact (point contact). This causes a problem that the rotation preventing pin may be damaged, because the contact surface pressure between the rotation preventing pin and the restraining member is increased. In regard to this point, in the fluid machine 1, the rotation preventing pin 71 has a substantially crowned shape as described above, thereby reducing the partial contact being applied. This is preferable because the contact surface pressure between the rotation preventing pin 71 and the restraining member 72 is effectively reduced.

As described above, in the structure that the crowned shape of the rotation preventing pin 71 includes the taper shape 713 and the R-shape, there is an advantage that the rotation preventing pin 71 can easily be fabricated, compared with a structure (not shown) that the rotation preventing pin 71 is crowned with higher accuracy. In other words, the above structure is preferable because the contact surface pressure between the rotation preventing pin 71 and the restraining member 72 generated while the turning scroll 4 is being revolved, can effectively be reduced by a simple fabrication.

[First Modification]

In the fluid machine 1, it is preferable that the taper angle α of the rotation preventing pin 71 and the inclination angle β at the side of the restraining member 72 has a relationship of $\alpha \geq \beta p$. In other words, it is preferable that the taper angle α of the rotation preventing pin 71 is set equal to or more than the inclination angle β of the turning scroll 4. In such a structure, the relationship between the taper angle α and the inclination angle β is optimized. Accordingly, the tapered surface (taper shape 713) of the rotation preventing pin 71 and the inner peripheral surface of the restraining member 72 are preferably in contact with each other while the turning scroll 4 is being revolved. This provides an advantage that the wear of the rotation preventing pin can be reduced, because the contact surface pressure between the rotation preventing pin 71 and the restraining member 72 is decreased.

In FIGS. 2, 4, and 5, the taper angle α of the rotation preventing pin 71 is generally set within a range of $0\ [\text{deg}] \leq \alpha \leq 45\ [\text{deg}]$. For example, in the embodiment, the taper angle α of the rotation preventing pin 71 is set to $\alpha=15$ [deg]. The taper angle α is also defined based on the range of the inclination angle β of the turning scroll 4. The inclination angle β of the turning scroll 4 is determined by the relationship between the end plate 41 of the turning scroll 4 and an accommodation space thereof (accommodation space of the front case 22 of the housing 2). The range of the inclination angle β changes according to a load of the turning scroll 4, and generally takes the maximum value when the maximum load is applied to the turning scroll 4. Therefore, it is preferable that the design of the taper angle α of the rotation preventing pin 71 is suitably changed according to the specifications of the fluid machine 1.

[Second Modification]

In FIG. 6, in the fluid machine 1, it is preferable that the rotation preventing pin 71 has a symmetrical shape in the longitudinal direction. In other words, it is preferable that the rotation preventing pin 71 does not have directivity. In such a structure, when the rotation preventing pin 71 is pressed into the insertion hole of the housing 2, either tip of the rotation preventing pin 71 may be the projecting side. This provides an advantage that the installation process of the rotation preventing pin 71 can be simplified (improve assemblability). For example, in such a structure, it is not necessary to distinguish which tip of the rotation preventing pin 71 is the projecting side.

In such a structure, as a result, the tip at the insertion side (the side pressed into the insertion hole of the housing 2) of the rotation preventing pin 71 has a crowned shape. Accordingly, the rotation preventing pin 71 can be pressed in more easily. This provides an advantage that the installation process of the rotation preventing pin 71 can be further simplified.

[Third Modification]

In FIG. 7, in the fluid machine 1, it is preferable that the taper shape 713 of the rotation preventing pin 71 changes in stages. This provides an advantage that the versatile taper shape 713 can be formed. The taper shape may be changed in two stages, or may be changed in a plurality of stages.

For example, in the embodiment, the taper shape 713 of the rotation preventing pin 71 has two types of taper angles $\alpha 1$ and $\alpha 2$, and is formed so as to taper towards the projecting side end in stages. More specifically, there is the side surface 711 of the rotation preventing pin 71, and a tapered surface that has the taper angle $\alpha 2$ is formed at the tip side thereof. A tapered surface that has the taper angle $\alpha 1$ is formed at the further tip side thereof (between the tapered surface with the taper angle $\alpha 2$ and the top surface 712). The taper angles $\alpha 1$ and $\alpha 2$ have a relationship of $\alpha 1 \leq \alpha 2$, and are formed so that the rotation preventing pin 71 tapers significantly towards the projecting side end.

A portion of the taper shape 713 that has the taper angle $\alpha 2$ (tapered portion at the side close to the side surface 711) comes into contact with the inner peripheral surface of the restraining member 72, when the inclination angle $\beta$ is increased while the turning scroll 4 is being revolved. Therefore, it is preferable that the taper angle $\alpha 2$ is an angle to reduce the contact surface pressure between the rotation preventing pin 71 and the restraining member 72, while the turning scroll 4 is being revolved. The design of the taper angle $\alpha 2$ is suitably changed according to the range of the inclination angle $\beta$ of the turning scroll 4.

A portion of the taper shape 713 that has the taper angle $\alpha 1$ (tapered portion at the side close to the top surface 712), for example, is set at a preferable angle to easily insert the rotation preventing pin 71 into the insertion hole of the housing 2. In other words, in the structure that the rotation preventing pin 71 has the taper shape 713 at the both ends in FIG. 5, the insertion process of the rotation preventing pin 71 can be simplified, because each tip has a tapered portion with the taper angle $\alpha 1$.

In the above structure, it is preferable that a width L1 of a portion with the taper angle $\alpha 1$ (width in a shaft direction of the rotation preventing pin 71) and a width L2 of a portion with the taper angle $\alpha 2$ have a relationship of $L1 < L2$. This provides an advantage that an effect to reduce the contact surface pressure between the rotation preventing pin 71 and the restraining member 72, and an effect to simplify the insertion process of the rotation preventing pin 71 can be effectively balanced.

[Fourth Modification]

In the fluid machine 1, the rotation preventing pin 71 is buried into the end plate 41 of the turning scroll 4, and the restraining member 72 is buried into the front case 22 of the housing 2. However, on the contrary, the rotation preventing pin 71 may be buried into the front case 22 of the housing 2, and the restraining member 72 may be buried into the end plate 41 of the turning scroll 4 (not shown). In FIG. 8, it is also possible to employ a structure that the rotation preventing pins 71 are respectively buried into the front case 22 of the housing 2 and into the end plate 41 of the turning scroll 4, and the rotation preventing pins 71 are connected via the single restraining member 72.

INDUSTRIAL APPLICABILITY

Accordingly, the fluid machine according to the present invention can advantageously prevent wear of the rotation preventing pin.

The invention claimed is:

1. A fluid machine comprising:

a housing;

a fixed scroll fixed with respect to the housing;

a turning scroll that revolves around the fixed scroll; and a rotation preventing mechanism that prevents a rotation of the turning scroll, wherein the rotation preventing mechanism includes a rotation preventing pin projected from a wall surface at a side of the housing or a side of the turning scroll and a restraining member that restricts a position of the rotation preventing pin by engaging with the rotation preventing pin, the restraining member has a cylinder shape and is disposed inside an insertion hole formed on the wall surface of the housing, and the rotation preventing pin includes a projecting portion including both a taper-shaped portion formed on a projecting side end thereof and a columnar-shaped portion, and the projecting portion is positioned inside the restraining member such as the projecting portion slidingly contacts with an inner peripheral surface of the restraining member, and the taper shaped portion of the rotation preventing pin changes in stages, wherein the stages comprise a first stage having a first length and a second stage having a second length.

2. The fluid machine according to claim 1, wherein a taper angle $\alpha$ of the rotation preventing pin and an inclination angle $\beta$ at a side of the restraining member has a relationship of $\alpha \geq \beta$.

3. The fluid machine according to claim 1, wherein the rotation preventing pin has a symmetrical shape in a longitudinal direction.

4. The fluid machine according to claim 1, wherein:

the first stage has a first taper angle $\alpha 1$, the second stage has a second taper angle $\alpha 2$, the first and second stages are configured to taper towards the projecting side end, and the first and second taper angles have a relationship of $\alpha > \alpha 2$.

5. The fluid machine according to claim 4, wherein the second stage having a taper angle $\alpha 2$ is designed to contact the inner peripheral surface of the restraining member when an inclination angle $\beta$ at a side of the restraining member is increased while the turning screw revolves around the fixed scroll.

6. The fluid machine according to claim 4, wherein a width of the first stage portion of the rotation preventing pin is less than a width of the second stage portion of the rotation preventing pin.

* * * * *

UNITED STATES PATENT AND TRADEMARK OFFICE

CERTIFICATE OF CORRECTION

PATENT NO. : 8,628,315 B2
APPLICATION NO. : 12/442810
DATED : January 14, 2014
INVENTOR(S) : Sato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1167 days.

Signed and Sealed this
Twenty-second Day of September, 2015

Michelle K. Lee

Michelle K. Lee
*Director of the United States Patent and Trademark Office*